US006378180B2

(12) United States Patent
Maranca et al.

(10) Patent No.: US 6,378,180 B2
(45) Date of Patent: Apr. 30, 2002

(54) METHOD AND APPARATUS FOR SPINNING AND CRIMPING A MULTIFILAMENT YARN

(75) Inventors: Mario Maranca, Dortmund; Frank Bäcker, Solingen; Hans-Rochus Gross, Bergisch Gladbach, all of (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/833,090

(22) Filed: Apr. 11, 2001

(30) Foreign Application Priority Data

Apr. 11, 2000 (DE) ..... 100 17 916

(51) Int. Cl.[7] ..... D02J 11/00

(52) U.S. Cl. ..... 28/221; 28/246; 28/271; 28/262

(58) Field of Search ..... 28/221, 247, 246, 28/262, 263, 258, 265, 266, 268, 271, 272, 220, 240, 245; 57/334, 908, 333, 332

(56) References Cited

U.S. PATENT DOCUMENTS 3,479,810 A * 11/1969 Eshius ..... 28/220
4,118,843 A 10/1978 Schippers et al.
6,076,345 A 6/2000 Weiss et al.
6,085,395 A * 7/2000 Weiss ..... 28/221
6,094,790 A * 8/2000 Weiss ..... 28/220
6,119,320 A 9/2000 Weiss

FOREIGN PATENT DOCUMENTS

DE 196 13 171 A1 10/1996
EP 0 784 109 A2 7/1997
EP 0 861 931 A1 9/1998

* cited by examiner

*Primary Examiner*—Danny Worrell
(74) *Attorney, Agent, or Firm*—Alston & Bird LLP

(57) ABSTRACT

The invention relates to a method and an apparatus for spinning and crimping a multifilament yarn, and wherein a thermoplastic melt is extruded through a spinneret to form a filament bundle. The filament bundle is divided into a plurality of bundle components before being crimped. Each bundle component is separately crimped and combined to a multifilament yarn after being crimped. The yarn is subsequently wound to a package.

18 Claims, 2 Drawing Sheets

METHOD AND APPARATUS FOR SPINNING AND CRIMPING A MULTIFILAMENT YARN

BACKGROUND OF THE INVENTION

The present invention relates to a method of spinning and crimping a multifilament yarn, as well as an apparatus for carrying out the method.

To produce a crimped yarn, it is known to extrude by means of a spinning apparatus from a thermoplastic melt a filament bundle consisting of a plurality of strandlike filaments. After a cooling, the filament bundle is crimped by means of a crimping unit. In this process, the individual filaments of the bundle are deformed to loops and coils, so that the yarn formed from the filament bundle exhibits a crimp. To achieve such a deformation of the filaments in the filament bundle, the crimping unit may be designed and constructed, for example, as a texturing nozzle, wherein the filament bundle is compressed to a yarn plug by means of a conveying medium. Thus, when the filament bundle impacts upon the yarn plug, the desired loops and coils of the individual filaments will take shape. To realize an as stable crimp as possible, the filament bundle is advanced through a heated conveying medium and simultaneously heated, so that a plastic deformation is allowed to occur in the individual filaments of the bundle. After cooling the yarn plug, same is transformed by withdrawing into a crimped yarn, which is subsequently wound to a package.

In its intensity and stability, the crimp of the yarn is decisively influenced by the deformation of the individual filaments, i.e., with the use of a texturing nozzle, by the plug formation, and by the heat treatment of the yarn plug. Thus, the parameters, which decisively influence the crimp results, are not only temperature and pressure of the conveying medium, but also the dwelling time of the yarn plug during the heat treatment.

For example, DE 196 13 177 discloses a method and an apparatus, wherein the filaments of the filament bundle having been converted to a yarn plug, advance through an extremely long cooling zone before being disentangled to the crimped yarn. However, this method basically involves the problem that a larger number of individual filaments within the bundle does not guarantee a uniform treatment both in the formation of loops and coils and in the heating and cooling of all filaments of the bundle.

It is therefore an object of the invention to provide a method and an apparatus for spinning and crimping a multifilament yarn, which enable the production of a qualitatively superior crimped yarn with a stable and uniform crimp of the filaments.

SUMMARY OF THE INVENTION

In accordance with the invention, the above and other objects and advantages are accomplished in that before crimping, the filament bundle is divided into a plurality of bundle components, with each bundle component being separately crimped. After crimping, the bundle components are combined to form a multifilament yarn.

The invention was not suggested either by the methods and apparatus disclosed in EP 0 861 931 and EP 0 784 109, since the known methods and apparatus relate exclusively to the production of a composite yarn from a plurality of individual yarns. Each of the individual yarns differs in its polymer, its color, and/or its treatment, with each individual yarn being produced from respectively one filament bundle. Each filament bundle receives an individual treatment. In comparison therewith, the method and apparatus of the present invention are directed to producing a yarn from a filament bundle of a single-colored polymer melt. In this connection, the invention distinguishes itself in particular in that the crimped yarn receives a high crimp level, which is increased by at least 10% in comparison with conventionally crimped yarns. As a result of dividing the filament bundle into a plurality of bundle components, the individual filaments undergo a particularly intensive treatment during the crimping process. The high crimp level produces a particularly great bulkiness of the yarns, which does extremely well in yarns for making carpets.

To ensure a uniform treatment of all individual filaments of the filament bundle, it is preferred to have approximately the same number of filaments in each bundle component, and to crimp each bundle component under substantially identical conditions.

The further development of the invention, wherein a texturing nozzle is used for crimping, distinguishes itself in that the dwelling time for treating the yarn plug is substantially increased without reducing the spinning speed.

In particular, during the cooling of the yarn plug, it is thus possible to realize even in a short cooling zone an intensive cooling, which ensures an adequately low temperature of the individual filaments, when the yarn plug is disentangled. With that, the loops and coils set in the individual filaments are maintained even at very high withdrawing speeds.

However, in the production of the crimped yarn, there is also the possibility of pretreating the bundle components at least in one step after cooling and before crimping. The pretreatment may be realized on the bundle components, for example, by an entanglement or false twist. In so doing, however, it is important that each bundle component be pretreated under identical conditions.

It would likewise be possible to subject the bundle components to at least one aftertreatment after crimping and before combining them. Likewise in this instance, the aftertreatment is performed under identical conditions, so that the filament strands of the crimped yarn exhibit largely identical properties.

The division of the filament bundle may occur both after cooling and before cooling the filament bundle. In the latter case, the division of the filament bundle is realized by a partition inside the spinneret. However, to partition the spinneret, it would also be possible to provide two spinnerets arranged in direct side-by-side relationship, with each spinneret receiving a melt of a polymer.

To combine after crimping the individual filaments of the bundle components to the crimped yarn, a further advantageous development of the invention proposes to combine the bundle components to the yarn by an entanglement. This allows to achieve a high yarn cohesion at the same time.

For carrying out the method, an apparatus is proposed wherein the extruded filament bundle is divided into a plurality of bundle components by a separating means, which extends in the path of the yarn upstream of the crimping unit. The crimping unit is composed of a plurality of identical texturing means, with one of the texturing means being associated to each bundle component. To join the bundle components to form the crimped yarn, a combining means is provided between the crimping unit and the takeup unit.

The separating means may be formed by a plurality of yarn guides, which are arranged inside the cooling device or between the cooling device and crimping unit. However, it is also possible to form the separating means by a partition, which extends inside the spinning unit.

As texturing means, it is preferred to use texturing nozzles, in which the bundle component advances via a conveying channel to a stuffer box. In the stuffer box, the filaments are compressed to a yarn plug. As a result of dividing the filament bundle, it is accomplished that the reduced number of the individual filaments makes it possible to realize a higher level of loop and coil formation within the yarn plug.

Since it is preferred to use heated conveying fluid in the texturing nozzle for forming the yarn plug, it is possible to advance the yarn plug for cooling on the circumference of a cooling drum. Such cooling drums include a radial cooling air stream, which penetrates the yarn plug lying against the circumference of the cooling drum for purposes of cooling it. This allows to accomplish a uniform and intensive cooling of all yarn plugs extending parallel on the circumference of the cooling drum, until the disentanglement point is reached.

It is preferred to use as combining means an entanglement nozzle, which advances the bundle components jointly in a yarn channel, to which an air jet is supplied in such a manner that the individual filaments of the bundle components intertwine.

The invention is not limited either to the individual treatment steps or to the named treatment means, since what is essential for the method includes both the division into bundle components and their equal treatment during the crimping, as well as the combination of all filaments to a yarn.

BRIEF DESCRIPTION OF THE DRAWINGS

In the following, the method and apparatus of the present invention are described in greater detail with reference to the accompanying drawings, in which.

DETAILED DESCRIPTION OF THE PREFERRED EMBODIMENTS

Figure 1:
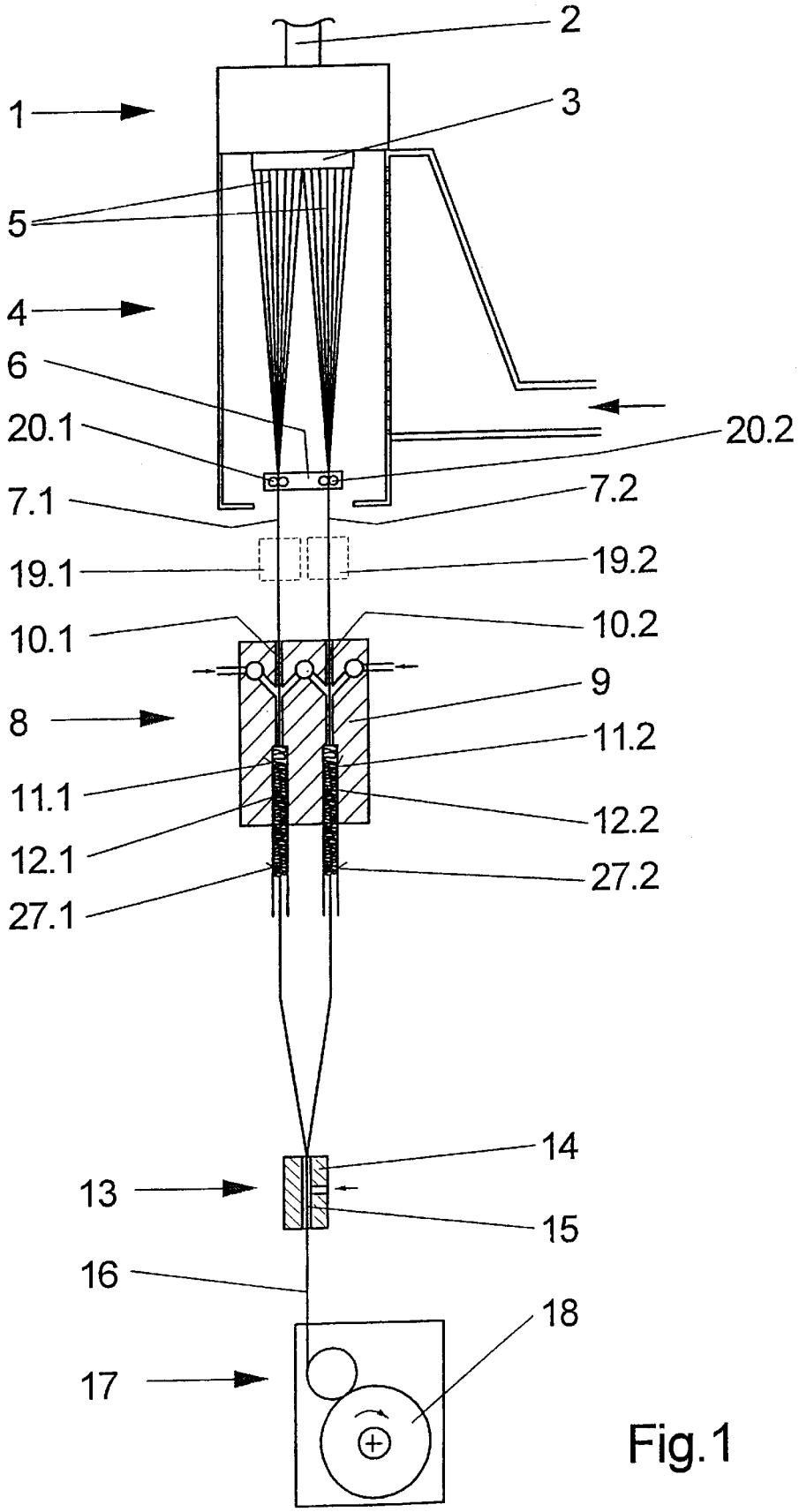
FIG. 1 is a schematic view of a first embodiment of the apparatus according to the invention.

FIG. 1 schematically illustrates a first embodiment of the apparatus according to the invention for carrying out the method of the present invention. The apparatus includes a spinning unit 1, which connects via a melt supply line 2 to a melt generator, for example a pump or an extruder (not shown). On its underside, the spinning unit 1 mounts at least one spinneret 3. The spinneret 3 comprises a plurality of nozzle bores, through which the melt supplied by spinning unit 1 is extruded under pressure to a plurality of individual filaments of a filament bundle 5. Downstream of spinning unit 1, a cooling device 4 is provided, through which the filament bundle 5 advances for purposes of cooling the filament strands, which emerge at approximately the melt temperature. In the Figure, the cooling device 4 is shown by the example of a transverse air flow system, which directs a cooling air substantially crosswise to the filament bundle 5.

In the outlet region of cooling device 4, a separating means 6 is arranged. The separating means 6 includes two yarn guides 20.1 and 20.2, which divide the filament bundle 5 into two bundle components 7.1 and 7.2 of substantially the same size.

Downstream of cooling device 4 is a crimping unit 8. The crimping unit 8 comprises two texturing means, which are designed and constructed as a texturing nozzle 9 with two conveying channels 10.1 and 10.2 arranged parallel in side-by-side relationship with two parallel extending stuffer boxes 11.1 and 11.2. From the outside, a heated conveying fluid, such as air, enters conveying channels 10.1 and 10.2 under pressure at a high velocity, so that a tension acts in the direction of the advancing yarn upon each bundle component 7.1, 7.2 advancing in conveying channel 10.1, 10.2. Outside of texturing nozzle 9, the stuffer boxes 11.1 and 11.2 are lengthened by concentrically attached tube sections 27.1 and 27.2 for guiding yarn plugs 12.1 and 12.2.

Arranged downstream of crimping unit 8 is a combining means 13. In the embodiment, the combining means 13 is designed and constructed as an entanglement nozzle 14. The entanglement nozzle 14 includes a yarn channel 15, in which the crimped bundle components 7.1 and 7.2 are jointly guided. In yarn channel 15, a compressed-air jet is introduced substantially crosswise to the direction of advance of the bundle components, so that an intensive entanglement of the individual filaments of bundle components 7.1 and 7.2 occurs inside the yarn channel 15. On the outlet side of combining means 13, a yarn 16 formed by crimped bundle components 7.1 and 7.2 is withdrawn by a takeup unit 17. In the takeup unit 17, the crimped yarn 16 is wound to a package 18.

In the embodiment shown in FIG. 1, a thermoplastic melt is supplied through melt supply line 2 to spinning unit 1. The melt consists of a polymer, for example, a polyester, a polyamide, or a polypropylene. To the melt, components may be mixed for producing, for example, a single-colored yarn. The melt is extruded under pressure through spinneret 3 to filament bundle 5. After being cooled in cooling device 4, the filaments of filament bundle 5 are divided by separating means 6 into two substantially identical bundle components 7.1 and 7.2. To this end, the bundle components 7.1 and 7.2 advance through yarn guides 20.1 and 20.2. The bundle component 7.1 is pulled through conveying channel 10.1 into texturing nozzle 9. Likewise, bundle component 7.2 is pulled through conveying channel 10.2 into texturing nozzle 9. Inside texturing nozzle 9, the bundle component 7.1 is compressed to yarn plug 12.1 in stuffer box 11.1. Parallel thereto, the bundle component 7.2 is compressed in stuffer box 11.2 to yarn plug 12.2. In this process, the conveying medium, preferably compressed air, is supplied to conveying channels 10.1 and 10.2 under the same conditions, in particular under the same pressure and at the same temperature, so that each of the bundle components is compressed to a yarn plug under the same conditions. During the formation of yarn plugs 12.1 and 12.2, the individual filaments of bundle components 7.1 and 7.2 are deposited in loops and coils and compacted. To intensify a crimp, the yarn plugs 12.1 and 12.2 may be heated inside stuffer boxes 11.1 and 11.2. At the end of stuffer boxes 11.1 and 11.2, which are lengthened by tube sections 27.1 and 27.2, the yarn plugs 12.1 and 12.2 are disentangled, with the bundle components 7.1 and 7.2 comprising crimped individual filaments. The bundle components 7.1 and 7.2 are combined and entangled inside entanglement nozzle 14 to form a crimped yarn 16, which is wound in takeup unit 17 into package 18.

By the method of the present invention a yarn is produced, whose individual filaments possess a very uniform and intensive crimp. Such yarns distinguish themselves by a crimp level, which is by 10% to 20% higher in comparison with known methods. The crimp of the filaments may be improved by pretreating bundle components 7.1 and 7.2 before crimping. To this end, the illustrated embodiment of FIG. 1 includes respectively one pretreatment means 19.1 and 19.2 upstream of crimping unit 8. The pretreatment means 19.1 and 19.2 may be formed, for example, by an additional entanglement nozzle. Important in this connection is that the bundle components 7.1 and 7.2 receive each the same pretreatment, so that the yarn 16 receives likewise a uniform filament structure.

Figure 2:
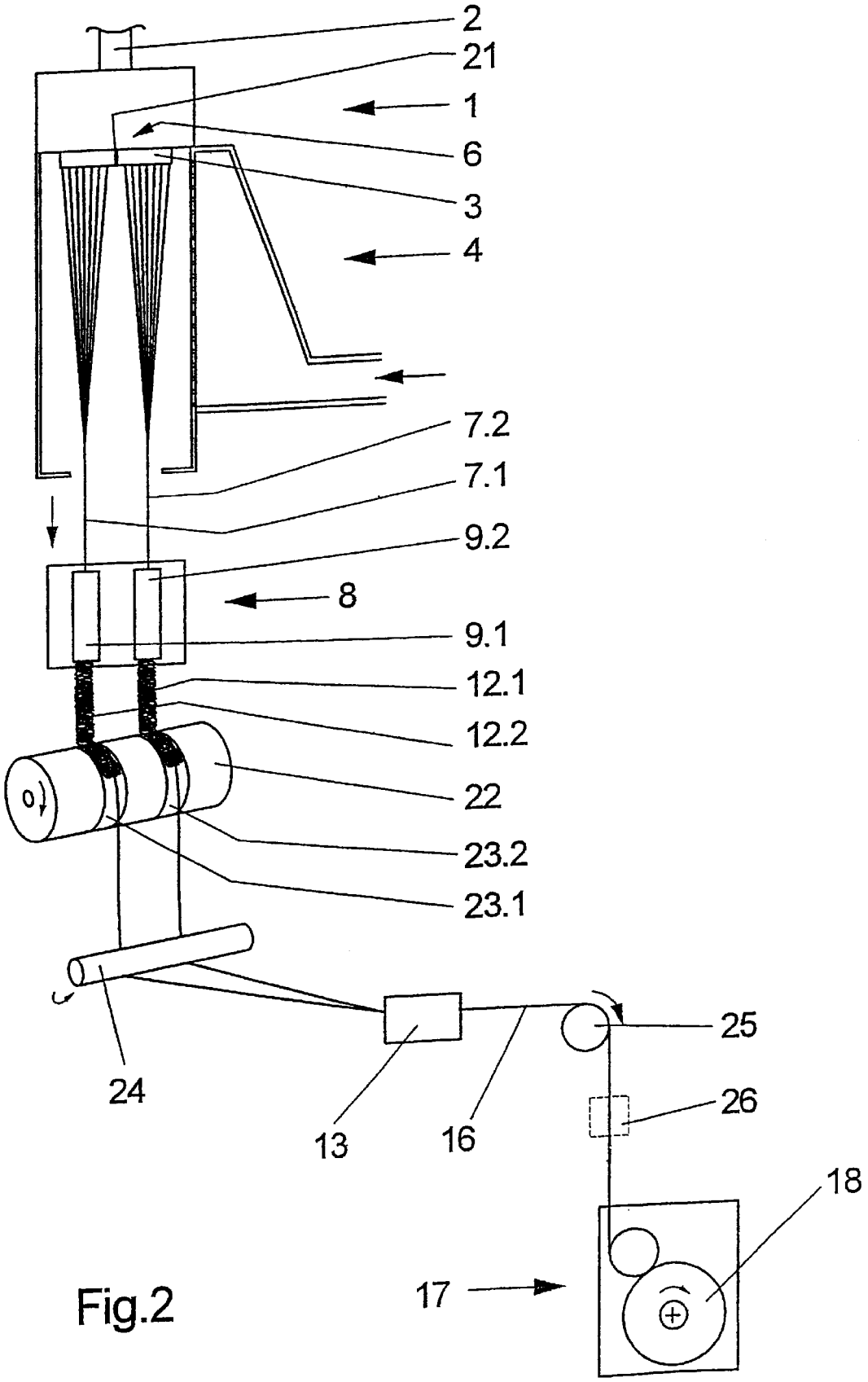
FIG. 2 is a schematic view of a further embodiment of the apparatus according to the invention.

FIG. 2 illustrates a further embodiment of the apparatus according to the invention for carrying out the method of the present invention. Components of like function are provided with like numerals.

The apparatus includes a spinning unit 1, which connects via at least one melt supply line 2 to a melt generator. The underside of the spinning unit mounts a spinneret 3 and a separating means 6. The separating means 6 is formed in spinneret 3 as a partition 21, which is used to attain a separation of filament bundle 5. Thus, the spinneret 3 extrudes a plurality of filaments, which are extruded in equal parts to a bundle component 7.1 and a bundle component 7.2.

Downstream of the spinning unit, a cooling device 4 is provided, which is constructed identical with the foregoing embodiment. To this extent, the foregoing embodiment is herewith incorporated by reference. In the path of the yarn, the cooling device 4 is followed by a crimping unit 8. The crimping unit 8 includes two texturing means 9.1 and 9.2. The texturing means 9.1 and 9.2 are each designed and constructed as a separate texturing nozzle, each having a yarn channel and a stuffer box. In this instance, the bundle components 7.1 and 7.2 are heated directly before forming the yarn plug. To this end, a heated conveying medium may be used in texturing means 9.1 and 9.2. Both bundle components 7.1 and 7.2 are heated to a substantially identical temperature. For cooling the yarn plugs 12.1 and 12.2, a cooling drum 22 is arranged downstream of texturing means 9.1 and 9.2. On its circumference, the cooling drum 22 comprises two parallel extending guide tracks 23.1 and 23.2. The guide tracks 23.1 and 23.2 are made air-permeable, so that an air stream formed in the interior of cooling drum 22 is directed radially outward through yarn plugs 12.1 and 12.2, which advance in guide tracks 23.1 and 23.2. With that, both yarn plugs 12.1 and 12.2 are evenly cooled. To disentangle the yarn plugs 12.1 and 12.2, a withdrawing means 24 removes bundle components 7.1 and 7.2 and advances them to a combining means 13. The withdrawing means 24 may be formed, for example, by a driven godet. Inside combining means 13, the bundle components 7.1 and 7.2 are combined to the yarn 16. A feed means 25 downstream of combining means 13 withdraws yarn 16 and advances it to takeup unit 17. In the takeup unit 17, the crimped yarn 16 is subsequently wound to a package 18.

In the embodiment shown in FIG. 2, the combining means may likewise be constructed as an entanglement nozzle. In this connection, it will be advantageous, when the withdrawing means 24 overfeeds the bundle components 7.1 and 7.2 to combining means 13, for purposes of obtaining an intensive intermingling of the individual filaments. To improve the intermingling of individual filaments within yarn 16, a further treatment of the yarn could occur in the form of an entanglement directly before winding. To this end, an entanglement nozzle 26 is shown in FIG. 2 in phantom lines directly upstream of takeup unit 17.

The embodiments for carrying out the method as shown in FIGS. 1 and 2 are exemplified in their arrangement and in their selection of alternative components. Thus, it is possible to introduce further pretreatment and aftertreatment steps, to attain, for example, a drawing or partial drawing of the bundle components or yarn. It is likewise possible to produce the deformations of the filaments in the bundle components by texturing means in the form of twist units. Likewise exemplified is the division of the filament bundles into two bundle components. To intensify the crimp, it is also possible to crimp more than two bundle components parallel to one another in side-by-side relationship, and to combine them thereafter to a yarn. Essential in this instance is that the treatment of the bundle components be performed under identical conditions to obtain from a polymer melt a yarn with a uniform filament structure.

What is claimed is:

1. A method of spinning and crimping a multifilament yarn comprising the steps of extruding a thermoplastic melt to form a bundle of advancing filaments, serially cooling and crimping the bundle of advancing filaments, dividing the bundle into a plurality of bundle components before the crimping step, so that each bundle component is separately crimped, and then combining the crimped bundle components to form a yarn which is wound to form a yarn package.

2. The method of claim 1, wherein the number of filaments in each bundle component is approximately the same, and wherein each bundle component is crimped under substantially identical conditions during the crimping step.

3. The method of claim 1, wherein the crimping step includes compressing each bundle component in a separate texturing nozzle to form a yarn plug, and separately disentangling the yarn plugs to form the crimped bundle components.

4. The method of claim 3, wherein the crimping step further includes heating each of the bundle components within their associated texturing nozzle, so that the crimped bundle components are cooled outside of their associated texturing nozzles.

5. The method of claim 1, wherein the crimping step includes conveying each bundle component with a heated fluid through a nozzle and into a stuffer box to form a compressed yarn plug, then cooling each yarn plug as it is advanced on the circumference of a cooling drum, and then separately disentangling the yarn plugs to form the crimped bundle components.

6. The method of claim 5, wherein the combining step includes advancing the crimped bundle components through a common entanglement nozzle while supplying an air jet thereto.

7. The method of claim 1, wherein each of the bundle components undergoes at least one pretreatment after the cooling step and before the crimping step.

8. The method of claim 1, wherein each of the bundle components undergoes at least one aftertreatment after the crimping step and before the combining step.

9. The method of claim 1, wherein the dividing step is conducted after or during the cooling step.

10. The method of claim 1, wherein the dividing step is conducted before the cooling step.

11. The method of claim 1, wherein the combining step includes entangling the crimped bundle components together.

12. An apparatus for spinning and crimping a multifilament yarn, comprising an extruder for spinning a thermoplastic melt to form a bundle of advancing filaments, a cooling device for cooling the bundle of advancing filaments, a crimping unit for crimping the cooled bundle of advancing filaments, a separating means positioned upstream of the crimping unit for dividing the bundle into a plurality of bundle components, said crimping unit comprising a plurality of texturing means arranged parallel to each other in a side by side relationship, with one of the texturizing means being associated to each bundle component, a combining unit positioned downstream of the crimping unit for joining the bundle components to form a multifilament yarn, and a take up device for winding the multifilament yarn to form a yarn package.

13. The apparatus of claim 12, wherein the separating means comprises a plurality of yarn guides arranged in the cooling device or between the cooling device and the crimping unit.

14. The apparatus of claim 12, wherein the extruder includes a spinneret, and wherein the separating means comprises a partition positioned immediately adjacent the spinneret.

15. The apparatus of claim 12, wherein each of the texturing means comprises a texturing nozzle which has a conveying channel for the associated bundle component and which leads to a stuffer box for producing a yarn plug.

16. The apparatus of claim 15, wherein each texturing nozzle further includes an air jet nozzle for introducing air into the conveying channel at high velocity so as to exert tension on the bundle component toward the stuffer box.

17. The apparatus of claim 16, further comprising a cooling drum arranged downstream of the texturing nozzles, with the cooling drum including a guide track on its circumference for receiving each yarn plug.

18. The apparatus of claim 12, wherein the combining unit comprises an entanglement nozzle which includes a yarn channel and an air jet communicating with the yarn channel.

* * * * *